US005253498A

United States Patent [19]

Benedict

[11] Patent Number: 5,253,498

[45] Date of Patent: Oct. 19, 1993

[54] BENDING BRAKE WITH MULTIPLE SELECTIVELY OPERATIVE CLAMP JAWS

[75] Inventor: Roger J. Benedict, Rockford, Ill.

[73] Assignee: Roper Whitney Company, Rockford, Ill.

[21] Appl. No.: 933,776

[22] Filed: Aug. 24, 1992

[51] Int. Cl.[5] ..... B21D 5/04

[52] U.S. Cl. ..... 72/25; 72/319

[58] Field of Search ..... 72/319-323, 72/226, 21, 25, 477, 472; 29/39

[56] References Cited

U.S. PATENT DOCUMENTS

| | | | |
|---|---|---|---|
| 1,833,376 | 11/1931 | Simmons | 72/226 |
| 2,685,122 | 8/1954 | Berthiez | 29/39 |
| 2,748,864 | 6/1956 | Ewaldson | 29/39 |
| 4,312,105 | 1/1982 | Brown | 29/39 |
| 5,107,695 | 4/1992 | Vandenbroucke | 72/226 |

FOREIGN PATENT DOCUMENTS

| | | | |
|---|---|---|---|
| 1076608 | 3/1960 | Fed. Rep. of Germany | 72/319 |
| 472250 | 11/1914 | France | 72/320 |

OTHER PUBLICATIONS

Brochure-"Autobrake 2000" by Roper Whitney, published about Jun., 1991.

*Primary Examiner*—Daniel C. Crane
*Attorney, Agent, or Firm*—Vernon J. Pillote

[57] ABSTRACT

A bending brake including a horizontal lower clamp jaw, a bending beam mounted for pivotal movement about a horizontal relative to the lower clamp jaw, and an upper jaw carrier mounted for vertical movement into and out of work clamping engagement with the lower jaw. The upper jaw carrier has a plurality of clamp jaws mounted at angularly spaced locations on the carrier and carrier position control mechanism is provided for turning and locking the upper jaw carrier to selectively position different upper clamp jaws in an operational position relative to the lower clamp jaw.

14 Claims, 6 Drawing Sheets

FIG. 1
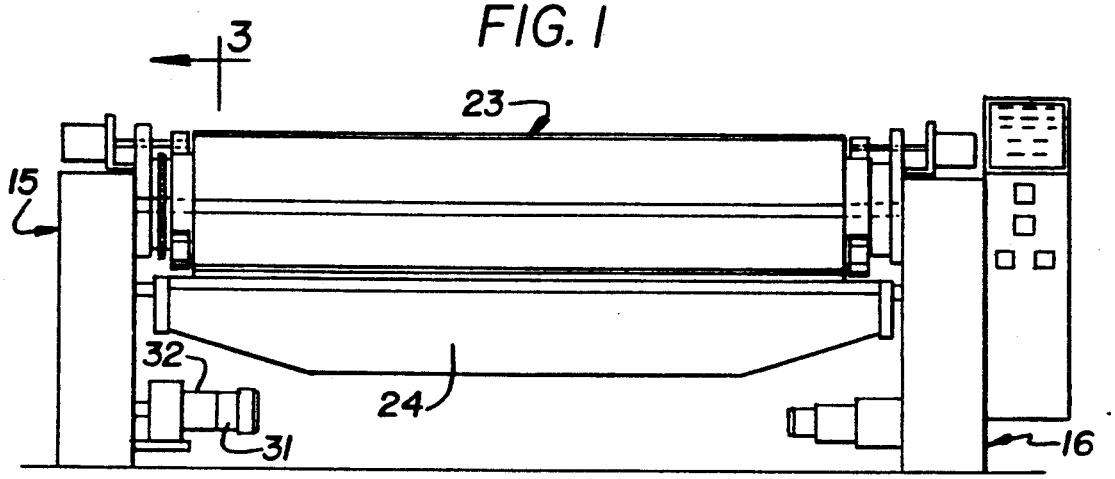
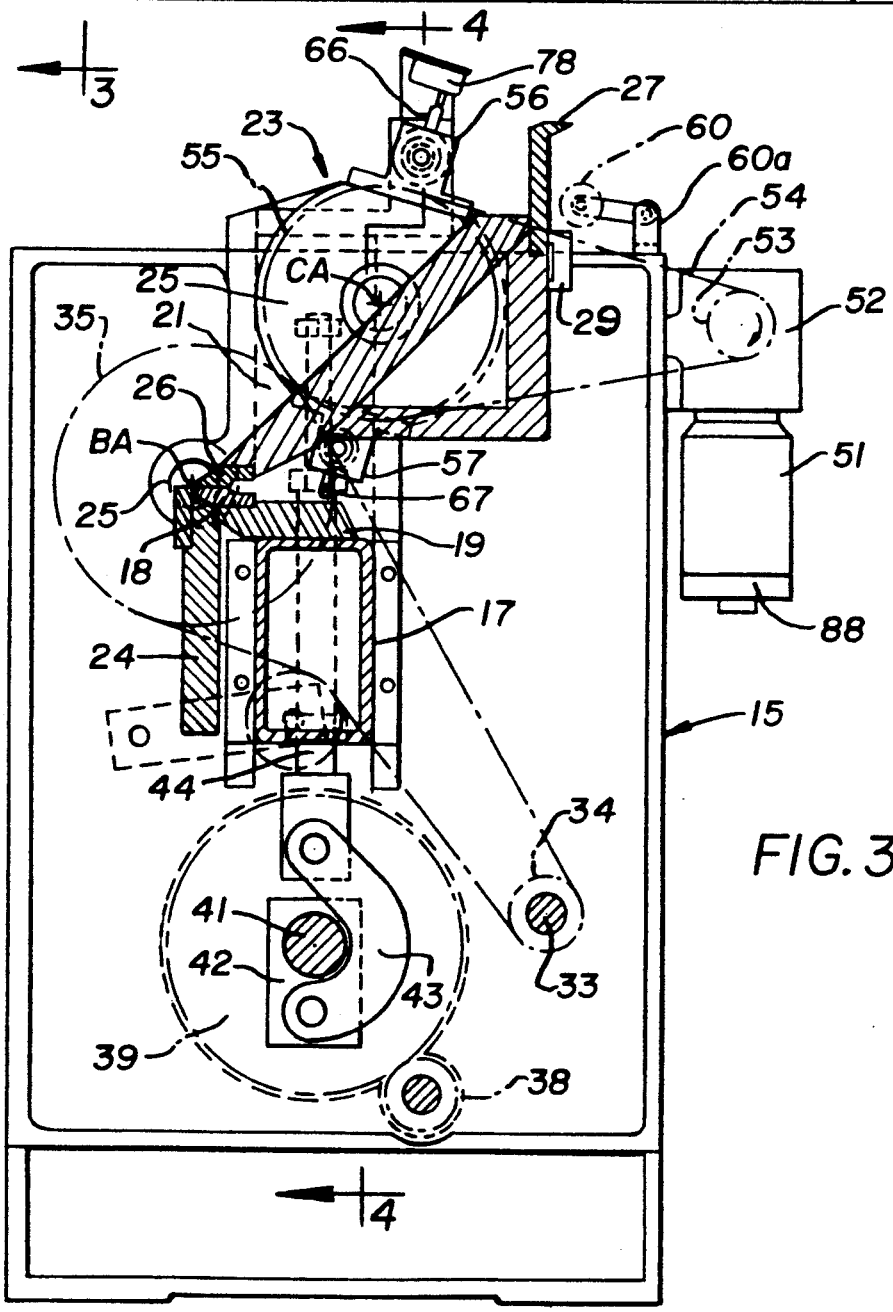
FIG. 3

BENDING BRAKE WITH MULTIPLE SELECTIVELY OPERATIVE CLAMP JAWS

BACKGROUND OF THE INVENTION

The present invention relates to bending brakes for bending sheet metal and the like and particularly to a bending brakes of the type having a stationary lower clamp jaw, an upper clamp jaw mounted on an upper jaw holder for movement into and out of clamping relation with the lower jaw, and a bending beam mounted for pivotal movement adjacent a bending edge of the lower jaw. In order to make some shapes requiring multiple bending operations on the workpiece, for example pans, panels and boxes, it is necessary to use upper clamp jaw tooling of different shape and/or length to form successive bends. Manually removing a set of upper clamp jaw tooling from the clamp jaw holder and replacing it with a different set of clamp jaw tooling, is laborious and time consuming and to expedite changing from one upper clamp jaw tooling set to another, a bending brake has heretofore been marketed by the assignee of the present invention with two sets of upper clamp jaw tooling mounted on an upper clamp jaw carrier. The upper clamp jaw carrier was mounted for turning movement about an axis parallel to the lower clamp jaw so that either of the two upper clamp jaws could be moved into an operational position relative to the lower clamp jaw. However, in order to change the position of the clamp jaws in this prior bending brake, it was necessary to manually unbolt opposite ends of the upper jaw carrier from lugs on a carrier support, then turn the upper jaw carrier in one direction away from the lugs to a second angular position in which the upper jaw carrier reengaged the lugs, and thereafter rebolt the upper jaw carrier to the lugs to hold the upper jaw carrier in a position in which the second clamp jaw tooling was in an operational position. While this prior bending brake markedly facilitated changing from one set of upper clamp jaw tooling to the second set of upper jaw tooling and back, the changeover still required substantial manual effort and time and, when making shapes requiring different tooling for a different bending operation, it was common practice in multiple piece operations to run a series of workpieces through the bending brake to form the bending operations that could be performed with one of the upper clamp jaws, and then change over to the other clamp jaw and re-run the series of workpieces to perform subsequent bending operations. This multiple handling of each workpiece markedly increased the overall labor and time required to completely form each workpiece.

SUMMARY OF THE INVENTION

It is an object of the present invention to provide a bending brake in which different sets of clamp jaw tools can be easily and rapidly moved into an operational position for use in clamping a workpiece to the lower clamp jaw during a bending operation.

Accordingly, the present invention provides a bending brake comprising a rigid frame means including first and second end frames, a stationary lower jaw means mounted on the frame means and having a horizontal bending edge intermediate the end frames, a bending beam mounted on the frame means for pivotal movement about a horizontal bending beam axis parallel to and adjacent the lower jaw means, power-operated beam operating means for pivoting the bending beam about the bending beam axis, first and second carrier support means mounted on the frame means adjacent the first and second end frame means respectively for up and down movement relative thereto, upper jaw carrier means having ends mounted on the carrier support means for up and down movement therewith and for turning relative thereto a carrier axis paralleling the bending beam axis, at least two upper clamp jaws mounted on the upper jaw carrier means at locations angularly spaced apart about the carrier axis, power-operated support moving means for moving the carrier support means downwardly to a lower clamp position and upwardly from the lower clamp position, power-operated carrier turning means for turning the upper jaw carrier means about the carrier axis, characterized in the provision of a carrier lock means including first and second sets of keepers respectively mounted on the ends of the upper jaw carrier means, each keeper being located at a preselected angular position relative to an associated one of the upper clamp jaw means, and first and second movable locking members respectively mounted on the first and second carrier support means for movement relative to the associated support means into and out of a carrier lock position engaging one of the keepers, and power-operated lock operating means for moving the first and second movable lock members between the carrier lock position and a carrier unlock position, and carrier position control means for controlling operation of the power-operated lock operating means and the power-operated carrier turning means.

BRIEF DESCRIPTION OF THE DRAWINGS

FIG. 1 is a front elevational view of the bending machine;

FIG. 3 is a vertical sectional view taken on the plane 3—3 of FIG. 1;

Figure 2:
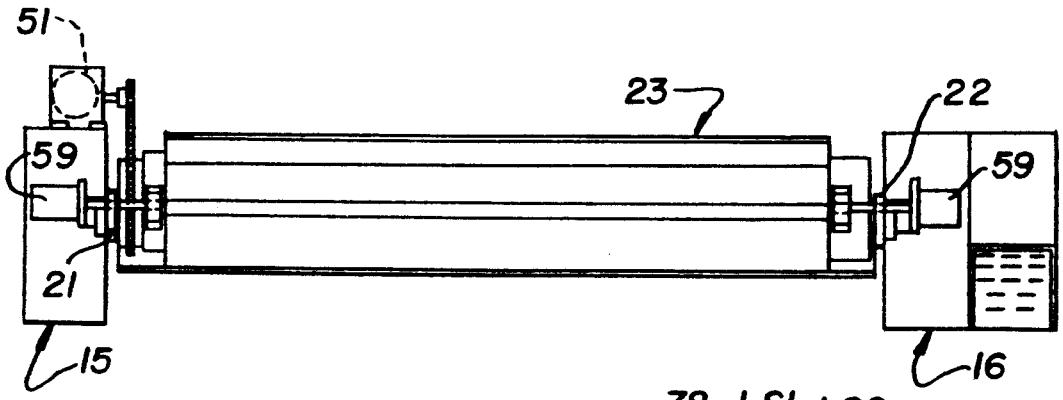
FIG. 2 is a top view of the bending machine.

The bending brake in general has a rigid frame structure including end frames 15 and 16 that are rigidly interconnected by a frame member 17. A horizontal lower clamp jaw 18 is mounted by a lower jaw carrier 19 on the frame member 17. A pair of carrier support members 21 and 22 are mounted on the end frames 15 and 16 respectively and an upper jaw carrier 23 having end members 25, is rotatably mounted on the carrier supports for rotation relative thereto about a horizontal carrier axis CA parallel to the lower clamp jaw 18. A bending beam 24 is pivotally mounted by trunnions 28 on the end frames for movement about a horizontal bending beam axis designated BA that is closely adjacent a forward bending edge of the lower clamp jaw for movement between a lower rest position as shown in FIGS. 3 and 5, through a preselected bending angle, to a raised position and back. In the embodiment of FIGS. 1–6, the upper jaw carrier 23 has two sets of upper clamp jaws 26 and 27 mounted thereon at angularly spaced locations. One of the clamp jaws 26 commonly has a straight continuous bending edge extending the length of the jaws. The other clamp jaw 27 is commonly formed in sections with spaces at selected locations along the jaw to accommodate previously formed flanges or bends in edges of the workpiece that are disposed transverse to the jaw 27. The tooling for jaw 27 is detachably clamped on carrier 23 by clamps 29 to enable manual changing or replacement of the tooling.

Power-operated means are provided for moving the bending beam 24 between the lower or rest position shown in FIGS. 3 and 5, through a preselected arc or bend angle to a raised position and back. The power-operated means includes a motor 31 (FIG. 1) and speed reducing gearing 32 that drives a shaft 33 rotatably supported in the end frames and extending therebetween. Shaft 33 is connected by sprockets 34 and chains to sprockets 35 at opposite ends of the bending beam, and motor 31 is reversible to enable selective raising and lowering of the bending beam.

Power-operated means are also provided for raising and lowering the carrier supports 21 and 22 in unison. For this purpose, a motor 36 is connected through a speed reducer 37 to a drive pinion 38 that meshes with a gear 39 on a shaft 41 rotatably supported on the end frames and extending therebetween. Crank arms 42 are non-rotatably connected to the shaft 41 adjacent opposite ends and the crank arms are connected through links 43 to the lower ends of an actuator rods 44. The actuator rods are slidable relative to a lower lug 45 on the carrier supports 21 and 22 and the rods 44 have reduced diameter upper ends that extends through an upper lug 46 on the associated carrier support. The reduced diameter end on the rods 44 forms a shoulder arranged to engage the upper lug to positively raise the carrier supports when the rods 44 are raised. Springs 48, such as bellville washers, are interposed between the upper lug and an adjustment nut 49 on the upper ends of the rods 44. The springs 48 are arranged to yield during clamping and limit the clamping force to a preselected range determined by the spring rate.

A carrier drive motor 51 is drivingly connected through the speed reducing gearing 52, sprocket 53, and chain 54 to a sprocket 55 non-rotatably connected to one of the carrier end members 25.

Figure 4:
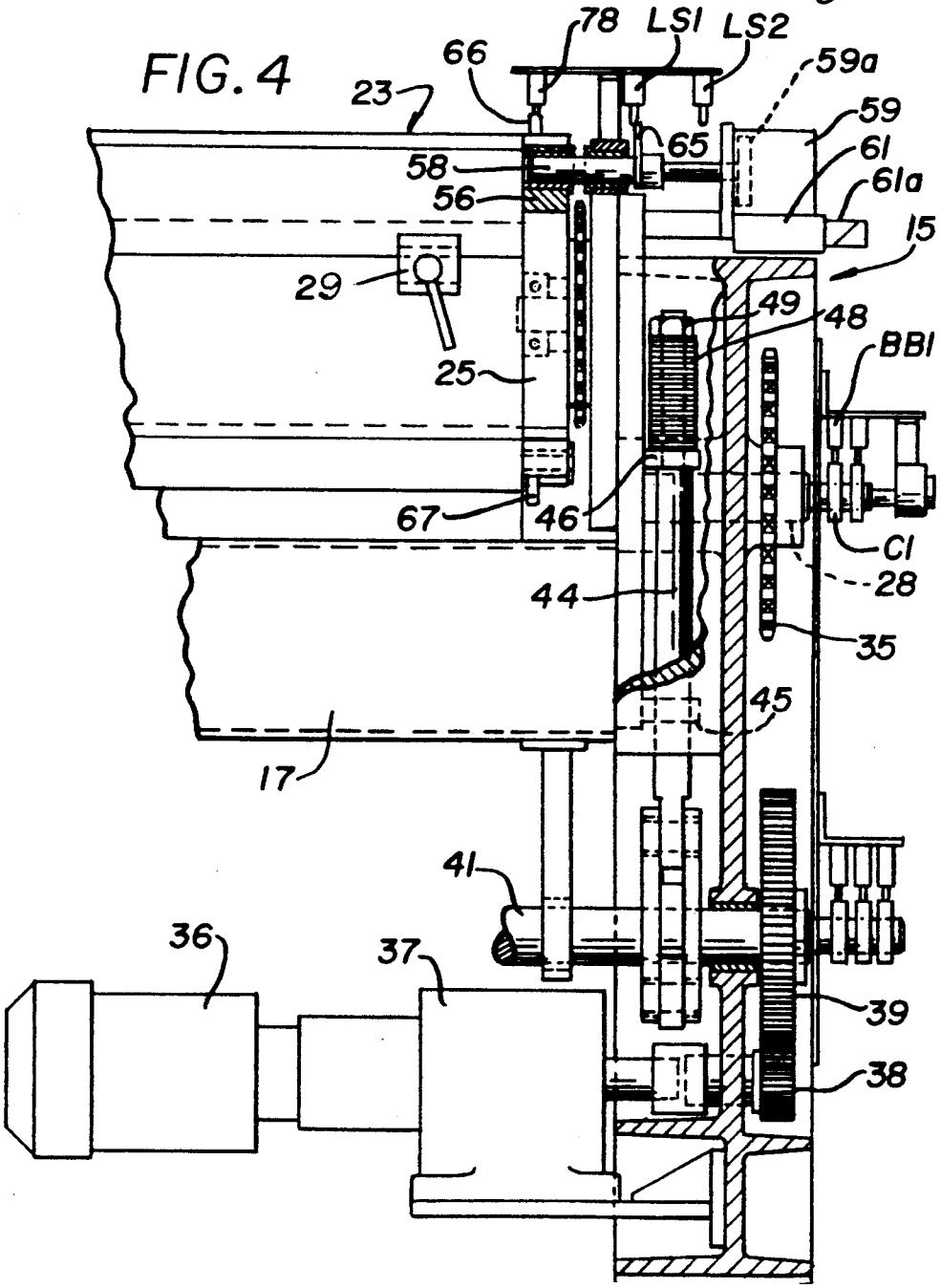
FIG. 4 is a fragmentary longitudinal sectional view taken on the plane 4—4 of FIG. 3.
Figure 5:
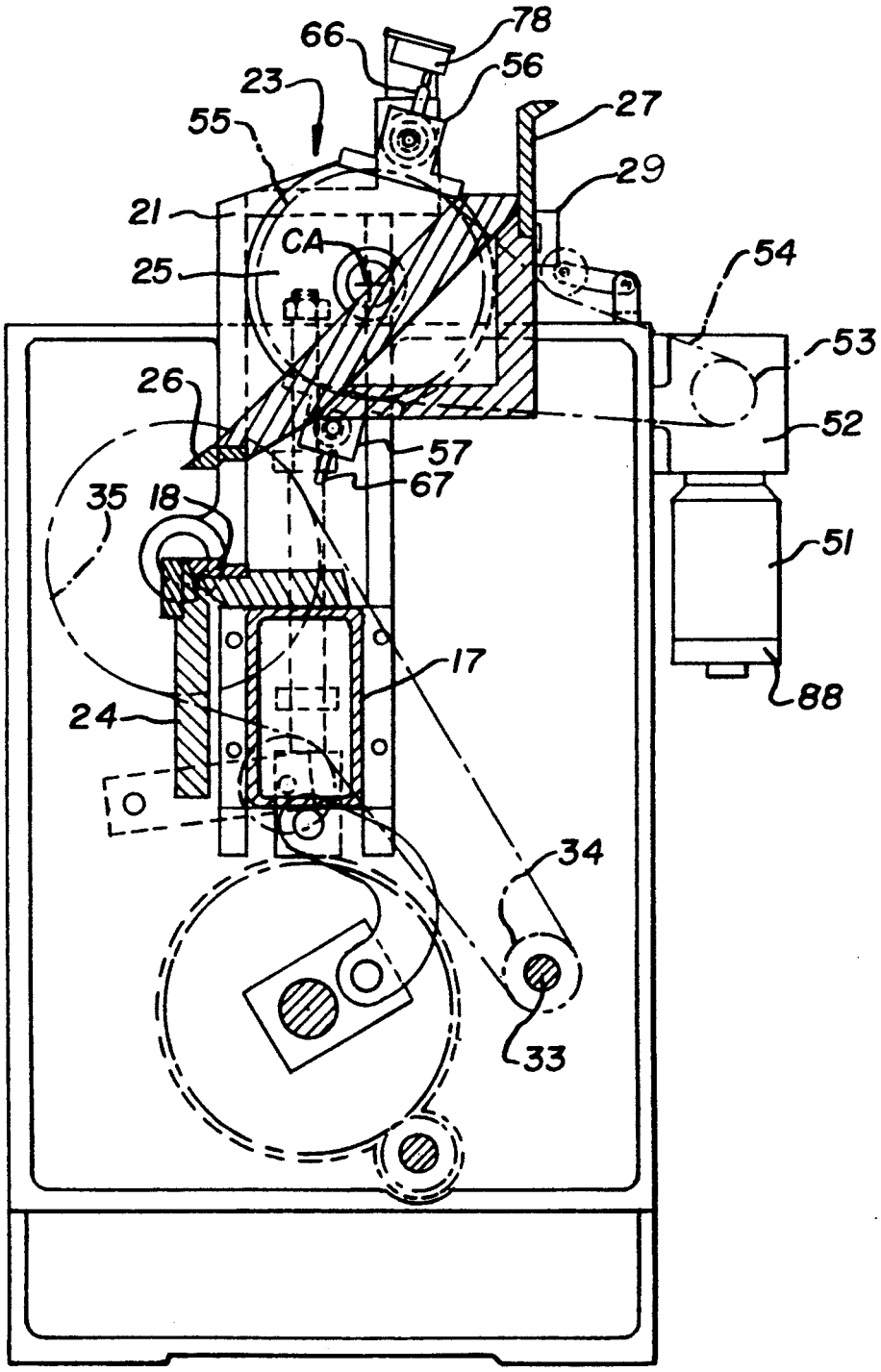
FIG. 5 is a vertical sectional view showing the upper jaw carrier in a raised position.
Figure 6:
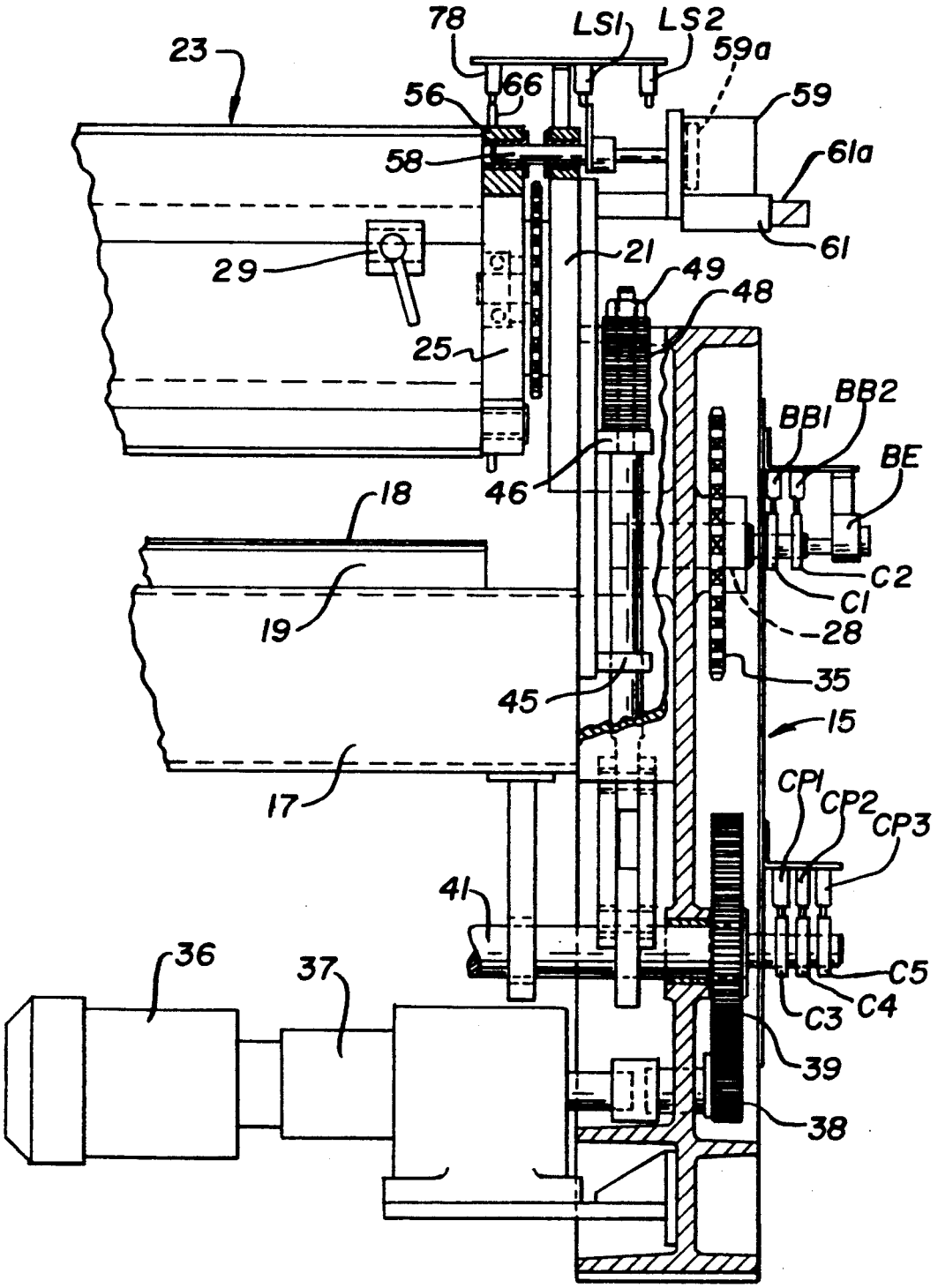
FIG. 6 is a fragmentary longitudinal sectional view showing the upper jaw carrier in a raised position.

As shown in FIGS. 4 and 6, a switch BB1 is arranged to be operated by a cam C1 on one of the trunnions 28 that rotates with the bending beam, for sensing when the bending beam is in its lower or zero position and a switch BB2 operated by a cam C2 is arranged to sense when the bending beam is in its maximum raised position, for example of the order of 145 degrees from zero position. An encoder BE is connected to the bending beam trunnions to sense beam positions intermediate the zero and maximum positions. Means are also provided for sensing the vertical position of the carrier. Switch CP1 operated by a cam C3 on shaft 41 is arranged to sense when the carrier support is in its fully raised position as shown in FIGS. 5 and 6. Switch CP2 operated from a cam C4 on shaft 41 is set to be actuated at a preselected safety clearance, for example 0.24 inches during downward movement of the upper clamp jaw, and a third switch CP3 operated from a cam C5 on shaft 41, is arranged to be operated at a preselected minimum clearance, for example 0.16 inches during raising and unclamping of the upper clamp jaws.

The construction of the bending brake as thus far described corresponds to that used in the prior art bending brake marketed by the assignee of the present invention. As discussed in the background of the invention, the prior bending brake was arranged so that a lug on each carrier support extended into the path of movement of the upper jaw carrier and rotation of the upper jaw carrier in one direction was stopped by engagement with the lug when one of the upper clamp jaws was in an operative position, and rotation of the clamp jaw carrier in the opposite direction was stopped by engagement with the lug when the other clamp jaw was in an operative position. The carrier drive motor 51 was manually controlled and included a slip clutch to prevent damage in the event the manually controlled energization of the motor was continued after the upper jaw carrier engaged the lug.

In accordance with the present invention, an improved arrangement is provided for rapidly and accurately repositioning the upper jaw carrier means to enable use of the tooling on the several clamp jaws on the carrier during a sequence of bending operations. For this purpose, a set of keepers 56 and 57 is mounted on the end members 25 at each end of the upper jaw carrier means with each keeper located at a preselected angular position relative to the associated one of the upper clamp jaws. In the embodiment of FIGS. 1–6, having two clamp jaws 26 and 27, one keeper 56 is positioned at a preselected angular relation to the jaw 26 and the second keeper 57 is positioned at a preselected angular relation to a second jaw 27. A movable locking member 58 is mounted on each carrier support for movement relative the associated support into and out of a carrier lock position engaging one of the keepers, and power-operated lock operating means 59 are provided for moving the movable lock members between the carrier lock and the carrier unlock position. The movable locking members 58 preferably comprise a pin or bolt mounted for sliding movement along an axis generally paralleling the carrier axis CA, and the keepers 56, 57 each include a member mounted on an end of the upper jaw carrier for limited angular adjustment relative thereto, and which have a bushing for receiving the locking member when the carrier means is in a selected angular position. The power-operated lock operating means 59 is advantageously arranged to both extend and retract the movable locking member and, in the embodiment shown, comprises a fluid cylinder having a piston 59*a* therein. Fluid such as compressed air is reversibly supplied by a two position flow reversing valve 61 actuated by an electroresponsive actuator such as a solenoid 61*a*.

Means are provided for sensing when the carrier locking means are in a lock position and in an unlock position. As shown in FIG. 4, switches LS1 and LS2 are mounted on one carrier support 21 for up and down movement therewith and a flag 65 is mounted for movement with the movable locking member to actuate switch LS1 when in the carrier lock position and switch LS2 when in the carrier unlock position. Means are also provided for sensing the angular position of the carrier relative to the carrier support means. As shown in FIGS. 3 and 4, the carrier position sensing means includes flags 66 and 67 each mounted on the rotatable carrier at a preselected angular position relative to associated one of the upper clamp jaw 26, and a switch means 78 arranged for actuation by the flags 66 and 67.

Figure 9:
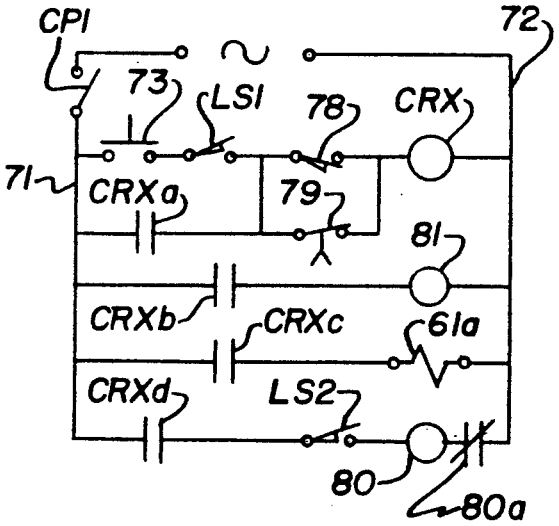
FIG. 9 is an electrical diagram schematically illustrating a carrier position control system.

A carrier position control circuit suitable for a bending brake in which the carrier has two clamping jaws, is shown in a ladder type circuit diagram in FIG. 9. Lines 71 and 72 are connected to a low voltage supply such as a 24 volt AC supply. Carrier support position switch CP1 is normally open and is arranged to be closed when the carrier support is in a preselected raised position sufficient to allow rotation of the carrier from one angular position to the other. A normally open start switch 73 is connected in series with a lock position sensing switch LS1 and carrier position sensing switch 78 to a control relay CRX. Switch 78 is normally closed but is opened when it senses one of the position flags 66 or 67. A timer operated switch 79 is connected in parallel with switch 78 and the timer operated switch is normally closed and operated to an open position by a timer 81. On closing of the start switch 73, a circuit is established through the lock position sensing switch LS1 and timer switch 79 to CRX and when CRX is energized, it closes relay contacts CRXa to establish a holding circuit for maintaining the relay energized when the locking pin moves to its unlock position. Relay CRX also closes contact CRXb to a timer 81; CRXc to the solenoid 61*a*, and CRXd connected in series with lock position sensing switch LS2 to a control relay 80 and overload relay 80*a* for the carrier drive motor 51. Motor 51 is advantageously of a type having a built-in brake 88 for rapidly stopping the motor shaft when the motor is de-energized, and in which the brake is automatically released when the motor is energized. The motor brake 88 is on the motor shaft and is actuated by springs when the motor is de-energized to rapidly stop the motor and the upper jaw carrier in a position to align a keeper 56 or 57 with the lock pin 58. The brake is energized by electromagnetic means to a release position, when the motor is energized. The motor 51 and speed reducer 52 are mounted on the end frame and a chain tensioning idler sprocket 60 is mounted by an adjustable bracket 60*a* on the end frame 21 to take out slack in the chain when the upper jaw carrier is in a raised position. Thus, when relay CRX is energized, it actuates solenoid 61*a* to move the movable locking member to an unlock position and, when the locking member is in unlock position it closes switch LS2 and energizes relay 80 to start the motor 51, release the brake 88 and rotate the carrier. Timer 81 is arranged to open the switch 79 a time delay after energization of the timer sufficient to allow the carrier to rotate one flag out of a position adjacent switch 78 so that switch 78 then closes and maintains the control relay energized until switch 78 is re-opened by the other flag on the carrier. Thus, when switch 78 is opened in response to movement of the carrier to its other operative position, control relay CRX is deenergized and this stops the motor 51, and de-energizes the solenoid 61*a*. When solenoid 61*a* is de-energized, the valve 61 returns to its normal position and applies pressure to the lock actuator to move the lock member 58 to a lock position.

Figure 7:
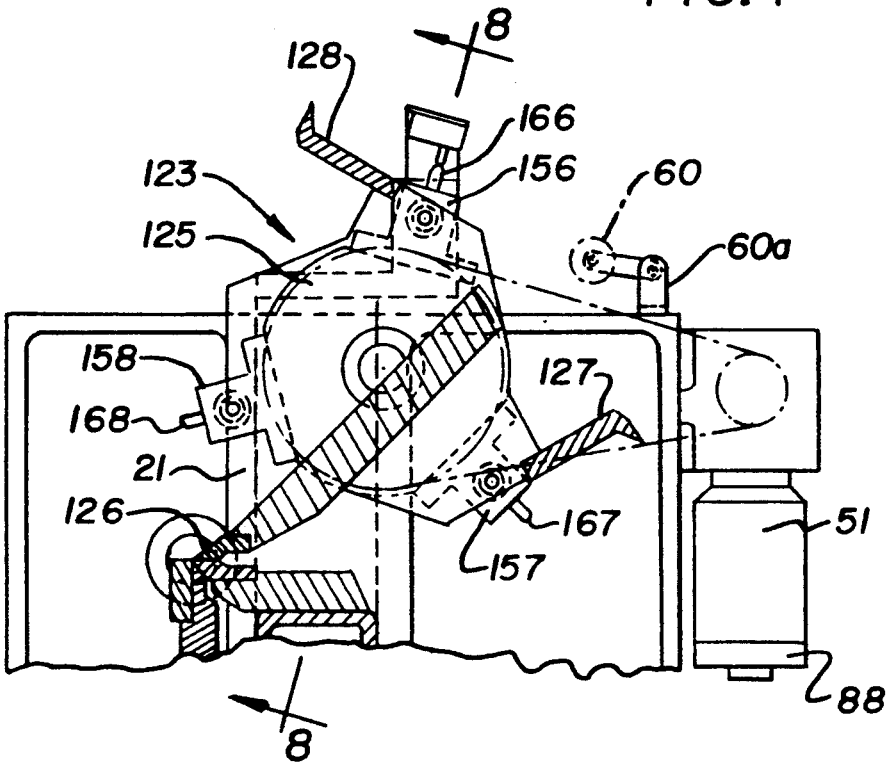
FIG. 7 is a fragmentary transverse sectional view showing a modified form of an upper jaw carrier.
Figure 8:
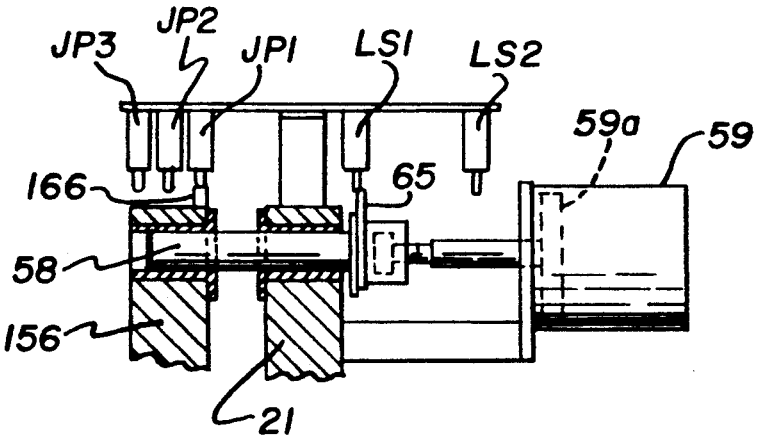
FIG. 8 is a fragmentary view taken on the plane 8-8 of FIG. 7 illustrating parts on a larger scale.

FIGS. 7 and 8 illustrate a bending brake with an upper jaw carrier having three clamp jaws. Like numerals are used to designate the same parts and numerals in the 100 series are used to designate modified parts. In this embodiment, the upper jaw carrier 123 has end members rotatably supported in the carrier supports 21 and 22 and three upper clamp jaws 126, 12?, and 128 are mounted on clamp jaw holders on the carrier at anqularly spaced locations about the carrier axis CA. As in the preceding embodiment, a carrier drive motor 51 having a brake 88 is drivingly connected through sprocket 53, chain 54 to a sprocket 55 on one of the carrier end members, for rotating the upper jaw carrier. Lock members 156, 157 and 158 are mounted on the carrier end members for limited angular adjustment relative thereto and each have a bushing for slidably receiving the locking member 58. Flags 166, 167 and 168 are mounted on one of the carrier end members, conveniently on the lock members 156, 157 and 158. The flags are positioned at locations spaced apart in a direction paralleling the axis of the carrier and the flags 166, 167 and 168 are respectively arranged to actuate switches such as proximity switches JP1, JP2 and JP3. As in the preceding embodiment, a flag 65 on the locking pin is arranged to actuate a switch LS1 when the locking pin is in its carrier lock position and to actuate a switch LS2 when the locking pin is in a carrier unlock position.

Figure 10:
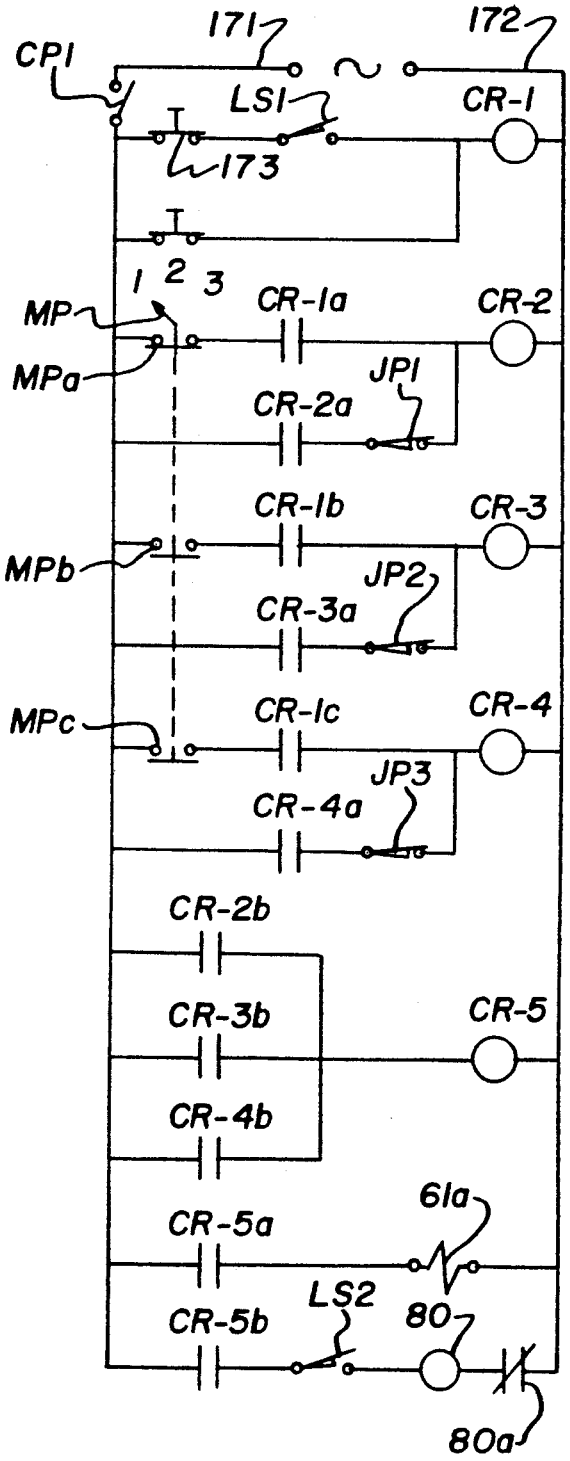
FIG. 10 is an electrical diagram illustrating a modified form of carrier position control.

FIG. 10 is a ladder diagram of the electrical carrier position control circuit. Lines 171 and 172 are connected to a AC supply such as a 24 volt AC supply. As in the preceding embodiment, a normally open switch CP1 actuated by the cam C3 on shaft 41 is arranged to sense when the upper jaw carrier has been moved to a raised position at least sufficient to provide clearance for the jaws when the carrier is rotated. Switch CP1 is connected in line 171 to prevent changing of the carrier position until the carrier is raised. A presettable means is provided for selecting the angular position to which the carrier is to be rotated and, as shown in FIG. 10, a multiple-position switch MP is operative in a first position to close only contacts MPa and in a second position to close only contacts MPb and in a third position to close only contacts MPc. A start switch 173 is connected in a series circuit with switch LS1 and a control relay CR1. As described in connection with FIG. 9, switch LS1 is normally open and is closed when the locking pin is in a carrier lock position. Accordingly, when start switch 173 is closed and the lock pin is in its carrier lock position, relay CR1 will be energized to close relay contacts CR1a, CR1b, and CR1c. Selector switch contacts MPa are connected in series circuit with relay contacts CR1a to a control relay CR2 and contacts MPb are connected in a series circuit with relay contacts CR1b to a control relay CR3 and contacts MPc are connected in a series circuit with relay contacts CR1c with a control relay CR4. Thus, when control relay CR1 is energized, either relay CR2 or CR3 or CR4 will be energized depending on whether the position control switch is in the first, second or third positions. Control relay contacts CR2 are connected in series with the normally closed carrier position switch JP1 in a holding circuit for relay CR2. Similarly, relay contacts CR3a are connected in series with a normally closed carrier position switch JP2 in a holding circuit for relay CR3 and normally open relay contacts CR4a are connected in a series circuit with a normally closed carrier position switch JP3 to provide a holding circuit for relay CR4. Control relays CR2, CR3 and CR4 are operative, when energized, to close the contacts CR2a, CR3a and CR4a respectively to establish a holding circuit to the associated control relay, and the relays are also arranged to close normally open contacts CR2b, CR3b and CR4b which are connected in parallel with each other and in series with relay CR5. Thus, whenever one of the control relays CR2, CR3, or CR4 are energized, relay CR5 will be energized to close normally open contacts CR5a and CR5b. Contacts CR5a are connected in series with the valve actuator solenoid 61*a* to reverse the application of fluid pressure to the lock pin actuator 59 and move the lock pin to its unlock position. Relay contacts CR5b are connected in series with the normally open lock pin sensing switch LS2 and, when the lock pin is in its unlock position, switch LS2 is closed to energize carrier drive motor 51 to rotate the upper jaw carrier. The motor 51 will continue to rotate the carrier until the carrier position sensing switch associated with the selected carrier position is opened by the associated flag on the upper jaw carrier. This causes de-energization of relay CR5 and de-energizes the motor 51 and actuates the brake 88 and de-energizes the valve actuating solenoid 61*a*. Thus, rotation of the motor 51 is stopped in the preselected angular position sensed by the carrier position sensing switch and de-energization of the actuating solenoid 61*a* causes the valve to return to a position applying fluid pressure to actuator 59 in a direction to move the lock pin 58 into its carrier lock position.

The carrier position selector switch and the start switch 73 as described above are manually actuated to effect rapid repositioning of the upper jaw carrier. However, it is known to use programmable CNC controls in bending brakes to control stock gauging, clamping and bending operations. It is deemed apparent that the position selection and initiation of a change in carrier position could be programmed into the CNC controls to effect automatic carrier position change in sequence with the clamping and bending operation.

The present invention enables rapid and accurate repositioning of the upper jaw carrier so that different upper clamp jaws can be selectively used in any desired sequence to form a workpiece. It is also contemplated that the upper jaw carrier could be selectively unlocked and rotated in a counterclockwise direction as viewed in FIG. 5 through a selected angle, for example twenty or thirty degrees, to disengage the clamp jaw from a workpiece after certain types of bending operations. For example, when a workpiece is bent in successive bending operations so that a flange on the workpiece is spaced above and overlies the body of the workpiece, the upper clamp jaw will engage the overlying flange when the clamp jaw is raised. The workpiece can be manually shifted to disengage the flange from the upper jaw but this requires significant effort on the part of the operator, particularly when forming large workpieces. With the present invention, the bending brake can be operated to unlock the jaw carrier and rotate the jaw carrier in a direction (counterclockwise as viewed in FIGS. 2, 3, 6 and 7) through an angle sufficient to disengage the upper jaw from the flanged workpiece as the jaw supports are operated to raise the jaw carrier. While the angular position of the jaw carrier relative to the carrier support is herein shown sensed by carrier position sensing switches, it is deemed apparent that a rotary encoder could be provided for sensing the angular position of the jaw carrier.

The embodiments of the invention in which an exclusive property or privilege is claimed are defined as follows:

1. In bending brake comprising, rigid frame means including first and second end frames, stationary lower jaw means mounted on the frame means and having a horizontal bending edge intermediate the end frames, a bending beam mounted on the frame means for pivotal movement about a horizontal bending beam axis parallel to an adjacent the bending edge of the lower jaw means, power-operated beam operating means for pivoting the bending beam about the bending beam axis, first and second carrier support means mounted on the frame means adjacent the first and second end frames respectively for up and down movement relative thereto, upper jaw carrier means having first and second ends respectively mounted on the first and second carrier support means for up and down movement therewith and for turning movement relative thereto about a carrier axis paralleling said bending beam axis, at least two upper clamp jaws mounted on the jaw carrier means at locations angularly spaced apart about the carrier axis, power-operated support moving means for moving the carrier support means downwardly to a lower clamp position and upwardly away from the lower clamp position, power-operated carrier turning means for turning the upper jaw carrier means about the carrier axis, and means for securing the carrier means to the carrier support means in different angular positions each corresponding to an operative position for one of the clamp jaws, the improvement wherein the securing means comprises first and second power-operated carrier lock means for locking the first and second ends of the upper jaw carrier means to the respective first and second carrier support means, the first and second power-operated carrier lock means each being operable to a carrier lock condition and to a carrier unlock condition, and carrier position control means for controlling operation of the power-operated carrier lock means and the power-operated carrier turning means, the carrier position control means including carrier support sensing means for sensing when the carrier support means is above a preselected raised position spaced above the lower clamp position a distance sufficient to allow turning of the upper jaw carrier means from one operative position to another operative position, lock condition sensing means for sensing when the power-operated lock means is in an unlock condition, and carrier index control means actuatable when the carrier support means is above the preselected raised position and the power-operated carrier lock means is in the unlock condition for operating said power-operated carrier turning means to turn the carrier means from one operative position to another operative position.

2. A bending brake according to claim 1 wherein said carrier position control means also includes carrier position sensing means for sensing the angular position of the upper jaw carrier means relative to the carrier support means.

3. A bending brake according to claim 1 wherein said carrier position control means also includes carrier position sensing means for sensing the angular position of the upper jaw carrier means relative to the support means and means responsive to said carrier position sensing means for deactuating the power-operated carrier turning means and stopping turning of the carrier means when the carrier means is turned to a preselected angular position relative to the support means.

4. A bending brake according to claim 3 including means responsive to said carrier position sensing means for actuating the power-operated carrier lock means to the carrier lock condition when the carrier means reaches the preselected angular position.

5. A bending brake according to claim 3 including means for preventing actuating of the power-operated carrier lock means to the carrier unlock condition when the carrier means is below the preselected raised position.

6. A bending brake according to claim 1 wherein the movable locking members each comprise a bolt mounted on the respective carrier support for sliding movement along an axis generally paralleling the carrier axis.

7. A bending brake according to claim 1 wherein said upper jaw carrier has three upper clamp jaws mounted thereon.

8. A bending brake according to claim 1 wherein said carrier position control means includes means for sensing when the carrier means is in each angular position corresponding to an operative position for a respective one of the clamp jaws, presetable means for selecting one of the angular positions, said carrier index control means deactuating the power-operated carrier turning means when the carrier means reaches the selected angular position.

9. A bending brake according to claim 8 including means for actuating the power-operated carrier lock means to the carrier lock condition when the carrier means reaches the selected angular position.

10. A bending brake comprising, rigid frame means including first and second end frames, a stationary lower jaw means mounted on the frame means and having a horizontal bending edge intermediate the end frames, a bending beam mounted on the frame means for pivotal movement about a horizontal bending beam axis parallel to an adjacent the bending edge of the lower jaw means, power-operated beam operating means for pivoting the bending beam about the bending beam axis, first and second carrier support means mounted on the frame means adjacent the first and second end frames respectively for up and down movement relative thereto, upper jaw carrier means having first and second ends respectively mounted on the first and second carrier support means for up and down movement therewith and for turning movement relative thereto about a carrier axis paralleling said bending beam axis, at least two upper clamp jaws mounted on the jaw carrier means at locations angularly spaced apart about the carrier axis, power-operated support moving means for moving the carrier support means downwardly to a lower clamp position and upwardly away from the lower clamp position, power-operated carrier turning means for turning the upper jaw carrier means about the carrier axis, and means for securing the carrier means to the carrier support means in angular positions each corresponding to an operative position for one of the clamp jaws, the improvement wherein the securing means comprises first and second power-operated carrier lock means for locking the first and second ends of the upper jaw carrier means in different angular positions relative to the respective first and second carrier support means, the first and second power-operated carrier lock means each being actuatable to a carrier lock condition and a carrier unlock condition, carrier position control means including, carrier support sensing means for sensing when the carrier support means is in a clamp position and when the carrier support means is in a preselected raised position spaced above the lower clamp position a distance sufficient to allow turning of the upper jaw carrier means from one of said operating positions to a second of said operating positions, lock condition sensing means for sensing when the carrier lock means is in a carrier lock condition and in a carrier unlock condition, carrier position sensing means for sensing when the carrier means is in each angular position corresponding to an operative position for a respective one of the clamp jaws, presetable means for selecting one of the angular positions, means for actuating the power-operated carrier lock means to the carrier unlock condition, and carrier index control means actuatable when the carrier support means is above the preselected raised position and the power-operated carrier lock means is in the unlock condition for operating said power-operated carrier turning means to turn the carrier means from one operative position to another operative position, means for deactuating the carrier turning means when the carrier means reaches the selected angular position, and means for actuating the power-operated carrier lock means to a carrier lock condition when the carrier means reaches the selected angular position.

11. A bending brake according to claim 10 including means for preventing actuation of the power-operated lock means to the unlock condition when the carrier means is below the preselected raised position.

12. A bending brake according to claim 10 wherein the first and second power-operated locking means each include a bolt mounted on the respective carrier support for sliding movement sliding movement along an axis generally paralleling the carrier axis.

13. A bending brake according to claim 10 wherein said upper jaw carrier has three upper clamp jaws mounted thereon.

14. A bending brake according to claim 10 wherein said first and second power-operated carrier lock means each includes a locking bolt mounted on each carrier support means for sliding movement between a carrier lock position and a carrier unlock position, and first and second sets of locking pin receivers on the first and second ends of the upper jaw carrier means, each locking pin received being located at a preselected angular position relative to an associated one of the upper clamp jaw means.

* * * * *

UNITED STATES PATENT AND TRADEMARK OFFICE

CERTIFICATE OF CORRECTION

PATENT NO. : 5,253,498

DATED : October 19, 1993

INVENTOR(S) : Roger J. Benedict

It is certified that error appears in the above-identified patent and that said Letters Patent is hereby corrected as shown below:

Claim 1, column 8, line 2, change "an" to -- and --;

Claim 10, column 9, line 30, change "to an" to -- and --;

Claim 14, column 10, line 51, change "received" to -- receiver --.

Signed and Sealed this

Twenty-ninth Day of March, 1994

Bruce Lehman

*Attest:*

BRUCE LEHMAN

*Attesting Officer*

*Commissioner of Patents and Trademarks*